United States Patent [19]

Dinwiddie

[11] 4,301,784

[45] Nov. 24, 1981

[54] FIREPLACE INSERT

[76] Inventor: C. Ray Dinwiddie, P.O. Box 1729, Olympia, Wash. 98507

[21] Appl. No.: 171,474

[22] Filed: Jul. 23, 1980

Related U.S. Application Data

[63] Continuation-in-part of Ser. No. 60,791, Jul. 25, 1979, abandoned.

[51] Int. Cl.[3] ..... F24B 7/00

[52] U.S. Cl. ..... 126/131; 126/121

[58] Field of Search ..... 126/121, 120, 131, 130, 126/139, 144, 145, 151; 237/51; 52/79.9

[56] References Cited

U.S. PATENT DOCUMENTS

| | | | |
|---|---|---|---|
| 1,653,466 | 12/1927 | Nickels | 126/121 |
| 1,773,858 | 8/1930 | Radford . | |
| 2,570,598 | 10/1951 | Roos | 126/131 X |
| 4,013,059 | 3/1977 | Andrews | 126/120 |
| 4,068,650 | 1/1978 | Nelson | 126/121 |
| 4,131,105 | 12/1978 | Moncrieff-Yeates | 126/131 X |
| 4,191,162 | 3/1980 | Simms | 126/121 X |
| 4,230,092 | 10/1980 | Henriques | 126/126 |

FOREIGN PATENT DOCUMENTS

| | | | |
|---|---|---|---|
| 225688 | 12/1959 | Australia | 126/138 |
| 585878 | 3/1977 | Switzerland | 126/121 |

*Primary Examiner*—Samuel Scott
*Assistant Examiner*—Randall L. Green
*Attorney, Agent, or Firm*—Graybeal & Uhlir

[57] ABSTRACT

An apparatus for improving the thermal efficiency of an existing fireplace is disclosed. The apparatus generally comprises a convection chamber having an open front and top, a bottom, a rear wall, and a plurality of side walls. The convection chamber is inserted into the existing fireplace and is spaced apart from the fireplace such that an air passage is defined under, behind, and along the sides of the convection chamber and the fireplace bottom, rear wall, and side walls respectively. The air passage draws room air to be heated under and behind the convection chamber, and discharges heated air into a room to be heated along the sides of the convection chamber in the air passage between the fireplace side walls and the convection chamber side walls.

23 Claims, 9 Drawing Figures

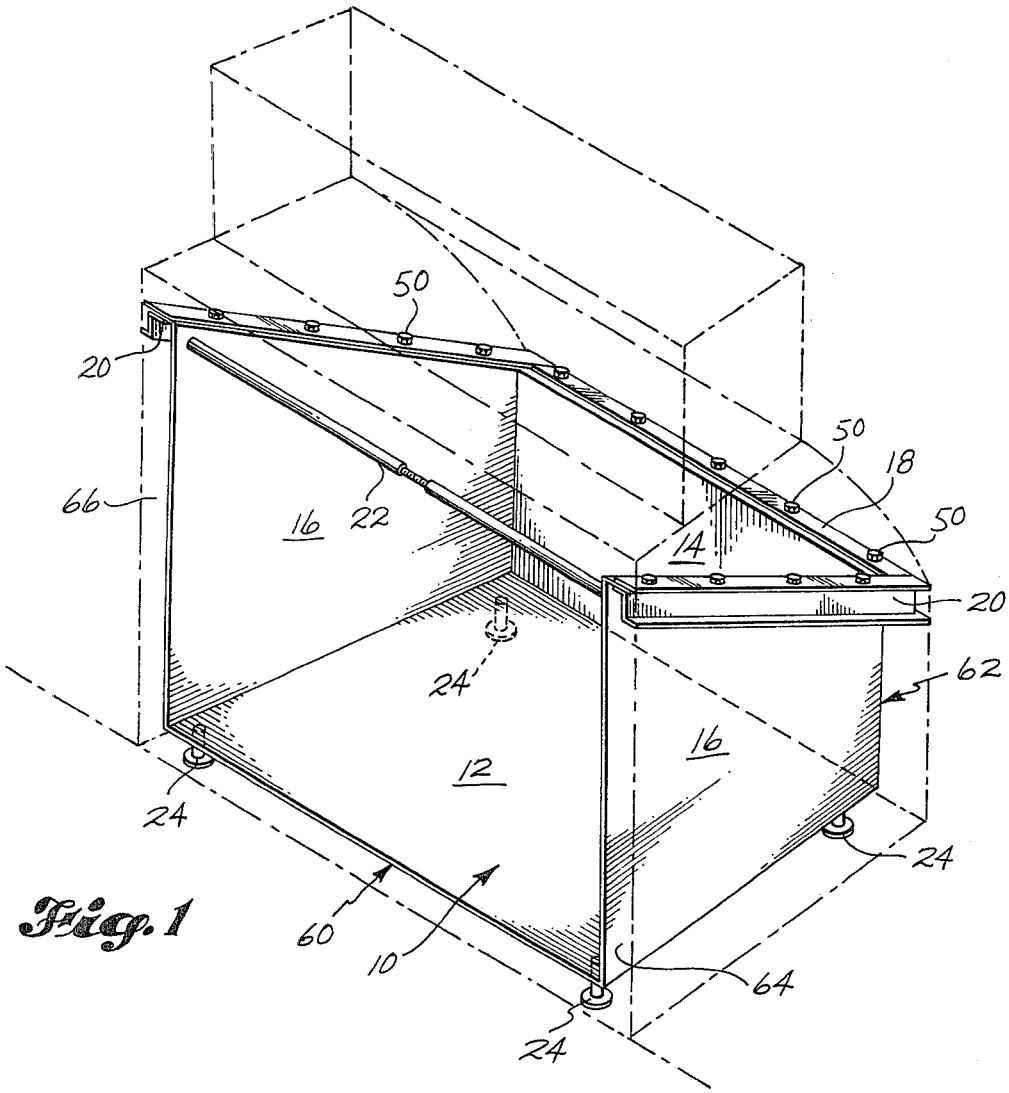
Fig. 1
Fig. 2
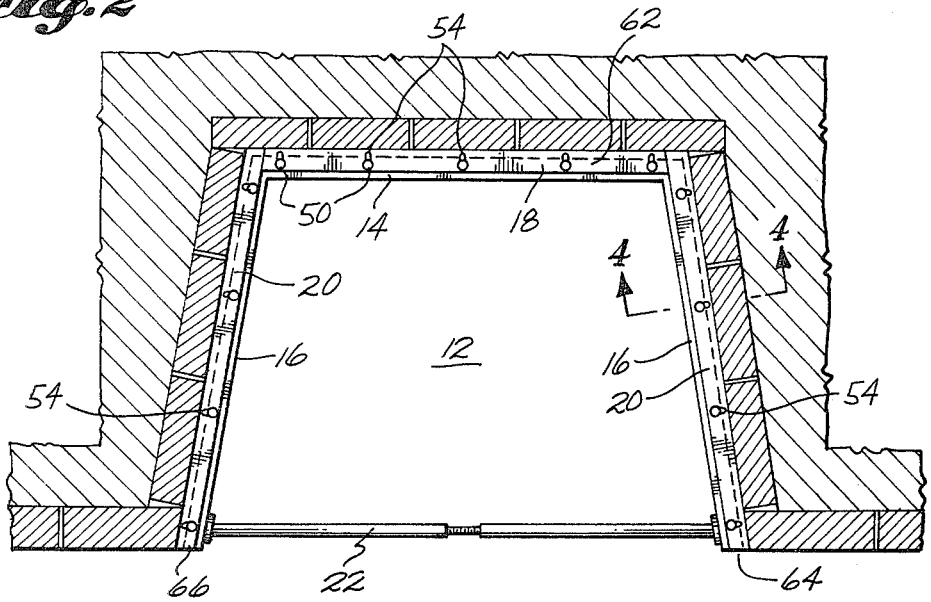

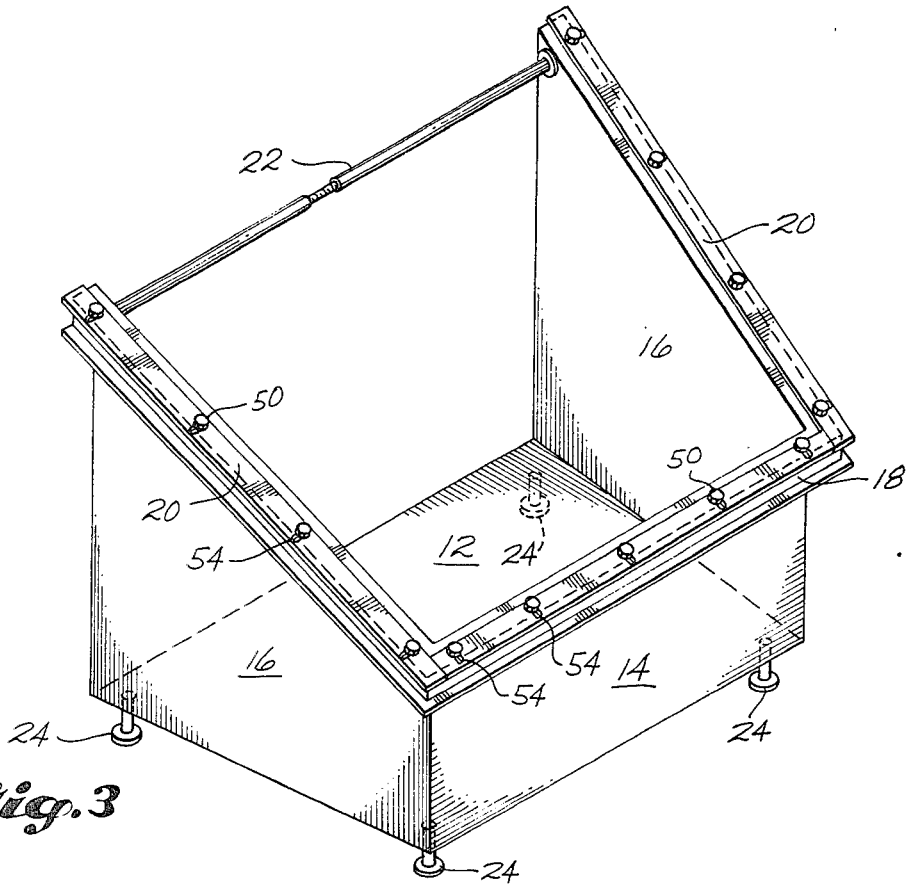
Fig. 3
Fig. 4
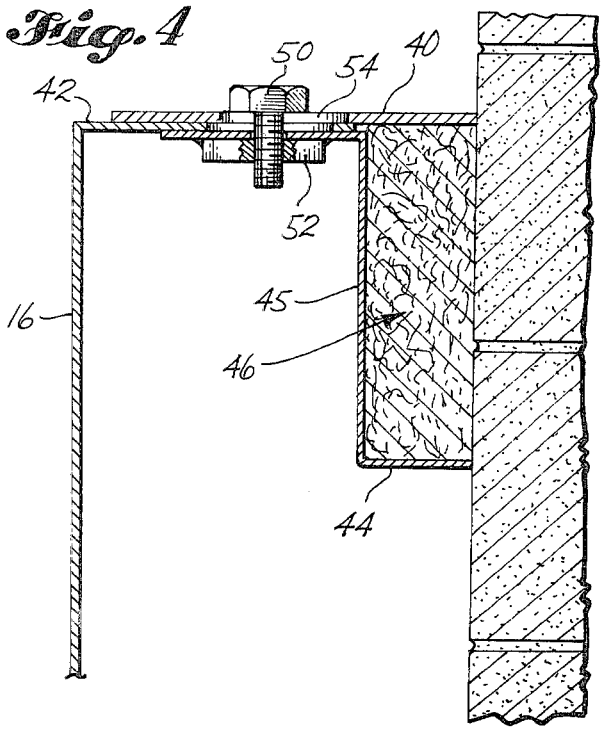

Fig. 7
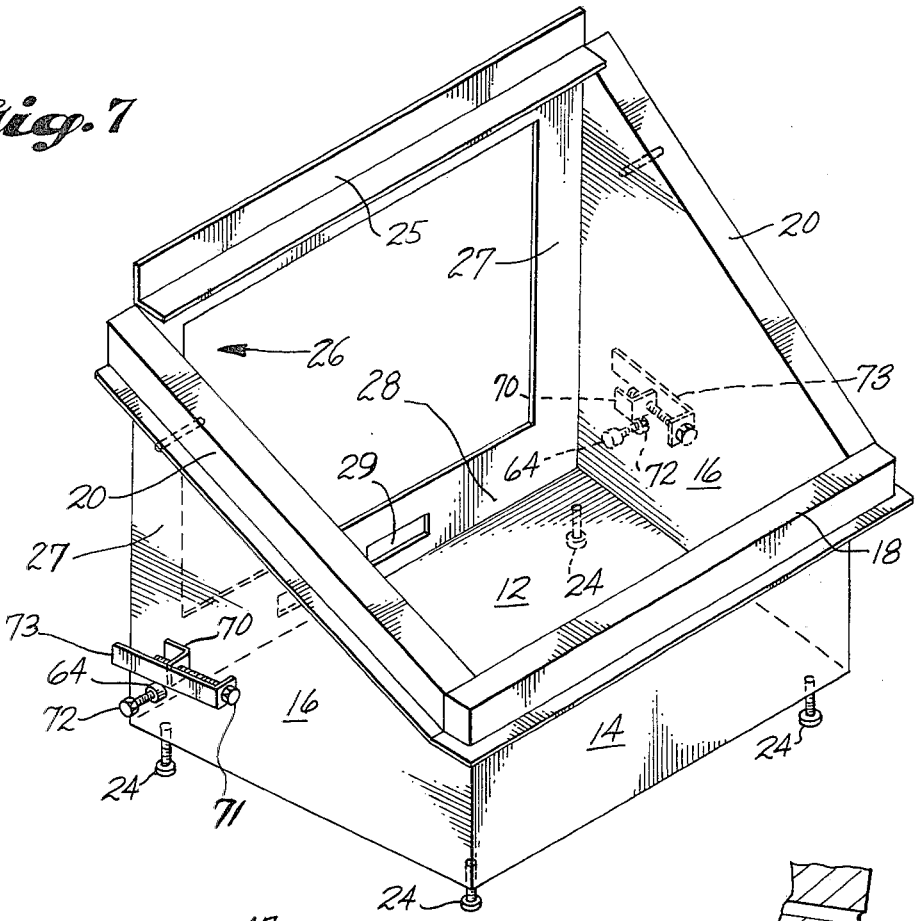
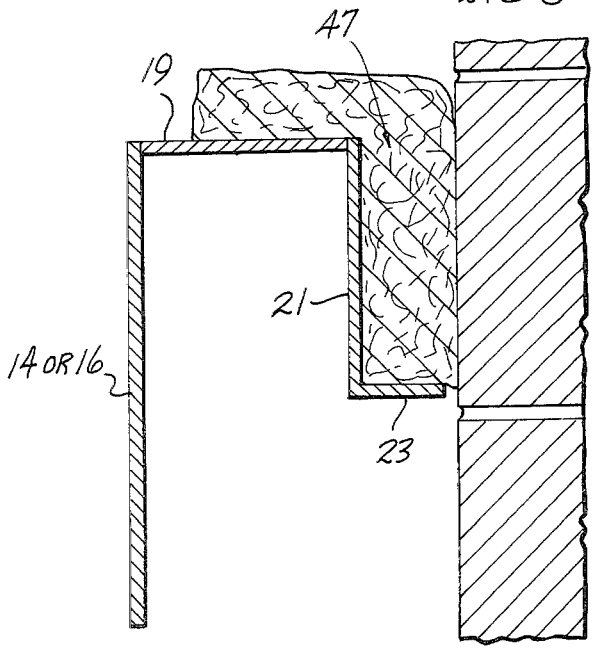
Fig. 8
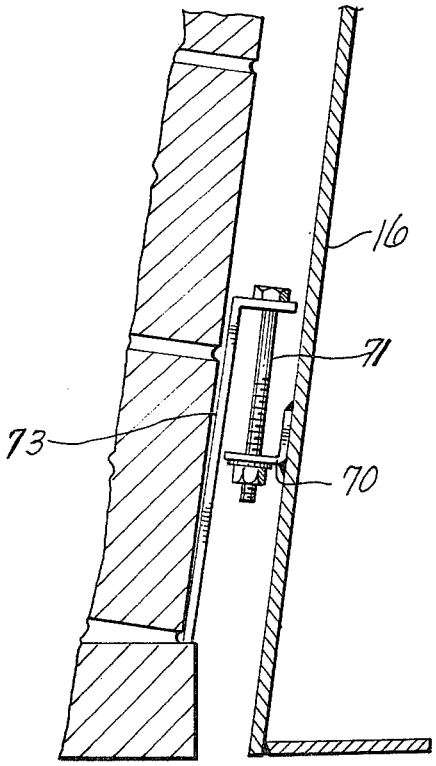
Fig. 9

FIREPLACE INSERT

DESCRIPTION

CROSS-REFERENCE TO RELATED APPLICATIONS

This is a continuation-in-part of application Ser. No. 60,791 filed July 25, 1979, now abandoned.

TECHNICAL FIELD

This invention relates to fireplace inserts, and more particularly to inserts used to improve the thermal efficiency of existing fireplaces.

BACKGROUND ART

Devices to improve the thermal efficiency of existing fireplaces are old in the art. One such device, shown by Nelson, U.S. Pat. No. 4,068,650, comprises a metal air conveying channel fitting closely against the inside walls of the existing fireplace. The interior of the channel contains an electric blower or the like, directing room air to be heated toward and through multiple horizontal passages or baffles contained within the channel. After the air has been heated it is subsequently discharged into the room. Devices of the type employing blowers and baffles have several disadvantages. Intially, any savings in energy achieved by using these devices to improve the thermal efficiency of the fireplace may be offset by the power required to operate the electric blowers within the channel. In addition, when in operation the blowers may create undesirable noise caused either by the blower motor or the vibration of the blower within the interior of the channel. The multiple horizontal passages contained within the channel make the device difficult to manufacture and install. These devices typically include a structural component placed over the fire to deflect the fire from its normal upward path. The structure typically hampers routine inspection and cleaning of the chimney which is necessary to prevent dangerous chimney fires. Further, these structures provide additional surface areas for the accumulation of uncombusted fire residules such as creosotes or the like. Thus, the inclusion of these structures mandates the total removal of the unit from the parent fireplace to permit the performance of these necessary preventative safety measures.

Another device insertable into an existing fireplace is shown by Wolcott, U.S. Pat. No. 886,453. The device generally comprises an open grate enclosed around the back and sides by hollow walls. Within the walls are a plurality of vertical and horizontal partitions giving the walls structural support. These partitions also define a plurality of compartments within the walls. Openings within the partitions allow room air to circulate behind the grate between adjacent compartments where it is heated and discharged back into the room. This device, and devices similar to this device, have several disadvantages. The limited openings within the partitions restrict the amount of room air which can be heated by the device thereby limiting any improvement in thermal efficiency. The hollow walls with the internal vertical and horizontal partitions, produce a device which is both difficult to manufacture and heavy. As a result, this device is not easily installed into a fireplace.

The present invention overcomes these problems of the prior art. By utilizing an air passage defined by the existing fireplace bottom, rear wall, and side walls, and the bottom, rear wall and side walls of a convection chamber insertable into the fireplace, the present invention heats the natural flow of room air drawn under and behind the convection chamber, and discharges it into the room. The present invention does not include any obstruction between the fire and the chimney. This allows the inspection and cleaning of the chimney without removal of the unit and minimizes the areas upon which uncombusted fire residues may accumulate. In that the present invention makes use of the existing fireplace structure, it is mechanically simple, easily constructed, and easily inserted into the fireplace without penetrating or in any manner damaging the existing fireplace structure. Due to the mechanical simplicity of the convection chamber the present invention does not detract from the aesthetic appearance of the existing fireplace.

DISCLOSURE OF THE INVENTION

According to one aspect of the present invention, an apparatus for improving the thermal efficiency of an existing fireplace comprises a convection chamber insertable into the fireplace. The convection chamber has an open front and top, a bottom, rear wall, and a plurality of side walls. The convection chamber, bottom, rear wall and side walls are held spaced apart from the existing fireplace bottom, rear wall, and side walls, respectively, thereby defining air passages between the convection chamber and the fireplace. The air passages draw air to be heated under and behind the convection chamber, and discharge heated air into a room from the air passages defined by the fireplace side walls and the convection chamber side walls. The convection chamber rear wall has a sealing means disposed along the top edge extending outwardly from the convection chamber rear wall toward the fireplace rear wall. This sealing means engages the fireplace rear wall preventing cold air drawn from the room to be heated from passing around the sealing means into the fireplace chimney. The convection chamber side walls each have sealing means disposed along their top edges extending outwardly from each side wall toward the fireplace side walls. These sealing means engage the fireplace side walls and prevent heated air from passing therearound.

One object of the present invention is to provide a fireplace insert that is mechanically simply and easily inserted into an existing fireplace.

A further object of the present invention is to provide a fireplace insert that does not penetrate or otherwise damage the existing fireplace structure.

A still further object of the present invention is to provide a fireplace insert that can easily be removed from a fireplace to return the fireplace to its original configuration.

A still further object of the present invention is to provide a fireplace insert which minimizes the areas upon which uncombusted fire residules may be accumulated or concealed.

The foregoing, and other objects, features, and advantages of the present invention will become more apparent in light of the detailed description of the preferred embodiments thereof set forth hereafter, and illustrated in the accompanying drawings.

BRIEF DESCRIPTION OF THE DRAWINGS

FIG. 1 is a front perspective view of one embodiment of the present invention showing a typical convection chamber inserted into an existing fireplace.

FIG. 2 is a top view of one embodiment of the present invention showing a typical convection chamber inserted into an existing fireplace.

FIG. 3 is a rear perspective view of a typical convection chamber.

FIG. 4 is a sectional view taken along lines 4—4 in FIG. 2.

FIG. 7 is a rear perspective view of the embodiment of the convection chamber shown in FIG. 5.

FIG. 8 is a sectional view of an alternate embodiment of the sealing means.

FIG. 9 is an enlarged view showing a typical angle and wedge plate.

BEST MODE OF CARRYING OUT THE INVENTION

Figure 5:
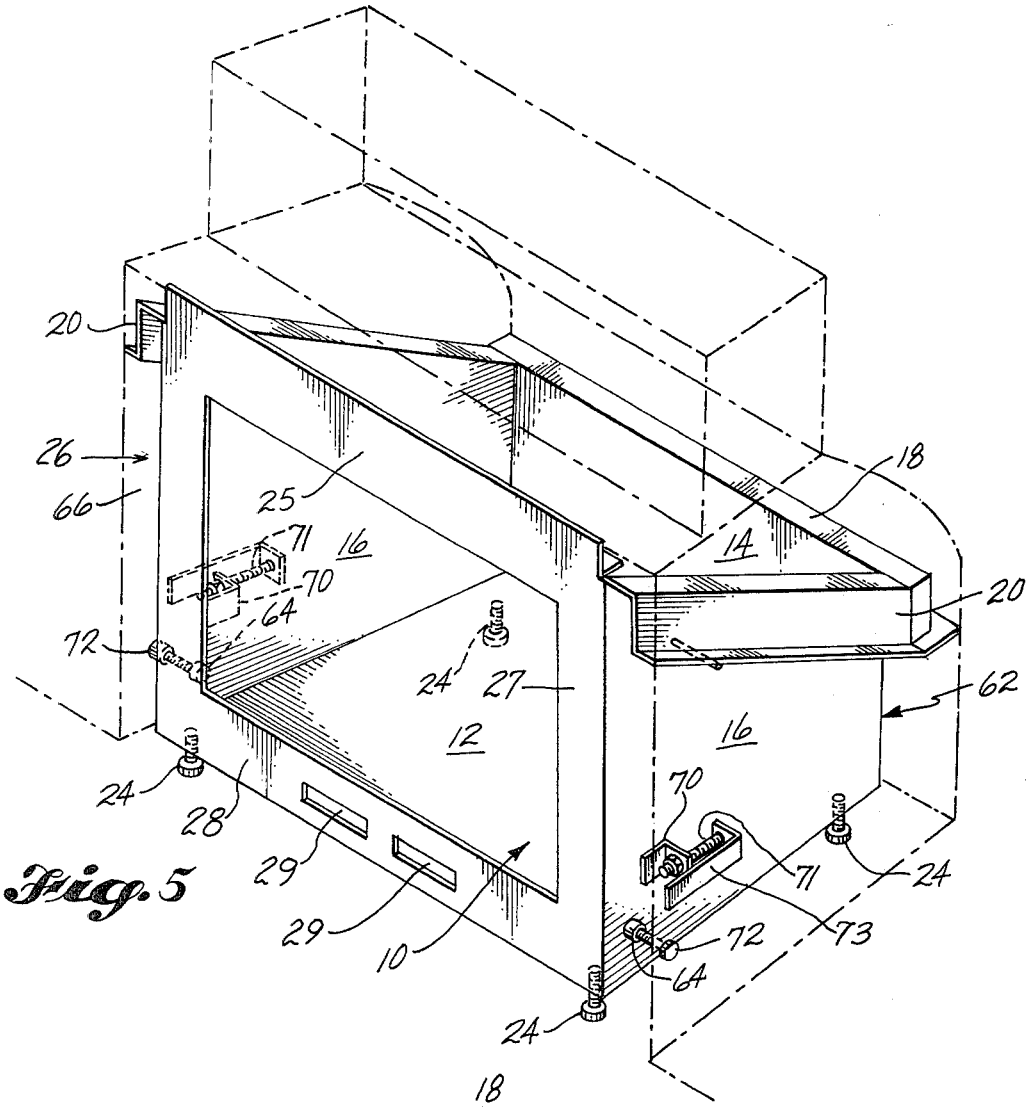
FIG. 5 is a front perspective view of an alternate embodiment of the present invention.

In one embodiment of the present invention, as best shown in FIG. 1, an apparatus for improving the thermal efficiency of an existing fireplace generally comprises a convection chamber, shown generally at 10, insertable into the fireplace (shown by broken lines in FIGS. 1 and 5). The convection chamber has an open front facing toward the room to be heated, a bottom 12, and a rear wall 14 secured to the bottom. A plurality of convection chamber side walls 16 extend upwardly from the bottom 12 and outwardly from the rear wall 14 toward the room to be heated. The convection chamber side walls are secured to both the convection chamber bottom and rear walls respectively. A rear wall sealing means 18 is disposed along the top edge of the convection chamber rear wall 14 and extends outwardly toward the fireplace rear wall. A side wall sealing means 20 is disposed along the top edge of each of the convection chamber side walls 16 and extends outwardly toward the fireplace side walls. An expanding means 22 extends across the open front of the convection chamber 10 along the open top and urges the convection chamber side walls outwardly toward the fireplace side walls. A plurality of adjustable legs 24 are disposed along the bottom 12 of the convection chamber 10 and raise or lower the convection chamber within the fireplace. With reference to FIGS. 1, 2 and 5, the convection chamber 10 is insertable into an existing fireplace such that the convection chamber bottom 12, rear wall 14, and the side walls 16 are spaced apart from the fireplace bottom, rear wall, and side walls respectively. In this manner, an air passage is defined between the convection chamber and the fireplace structure. The air passage draws room air to be heated under and behind the convection chamber, and discharges heated air into the room to be heated from the air passage defined between the fireplace side walls and convection chamber side walls.

The convection chamber bottom 12 is typically somewhat smaller than the existing fireplace bottom to permit the convection chamber bottom and the convection chamber rear wall 14 to define one wall of an air passage under and behind the convection chamber as will be discussed in more detail below. The bottom 12 is fabricated from metal, such as steel or the like, and has sufficient strength and rigidity to support combustible materials stacked on the convection chamber bottom without substantially deflecting or bending. Secured to the underside of the convection chamber bottom are a plurality of adjustable legs 24 permitting the convection chamber to be raised or lowered within the existing fireplace. The plurality of adjustable legs are old per se.

A convection chamber rear wall 14 extends upwardly from the convection chamber bottom 12 toward the fireplace chimney and is rigidly secured to the rear edge of the convection chamber bottom adjacent the fireplace rear wall such as by welding or the like. In an alternative embodiment, the convection chamber rear-wall 14 and bottom 12 may be fabricated from a single piece of material with a suitable bend occurring adjacent and spaced apart from the fireplace bottom and rear wall joint. As shown in the embodiment in FIG. 1, the convection chamber rear wall 14 is typically constructed from the same material as the convection chamber bottom. The convection chamber rear wall 14 has a rear wall sealing means 18 disposed along the top edge of the rear wall and extending outwardly toward the fireplace rear wall. The rear wall sealing means engages the fireplace rear wall and urges the convection chamber rear wall 14 apart from the fireplace rear wall such that an air passage is defined therebetween. In addition, the rear wall sealing means prevents air conveyed under and behind the convection chamber from reaching the fireplace chimney.

A plurality of convection chamber side walls 16 are disposed adjacent each end of the convection chamber bottom 12 and rear wall 14 respectively, and are secured to each such as by welding or the like. In an alternate embodiment, the convection chamber side walls may be integrally formed with the convection chamber bottom such as by constructing the bottom and side walls from a single metal plate with a bend formed adjacent and spaced apart from the joint between the fireplace bottom and side walls. Alternatively, the convection chamber side walls and the rear wall may be integrally formed from a single metal plate with a corresponding bend formed adjacent and spaced apart from the joint between the fireplace rear and side walls. Each convection chamber side wall is characterized by a side elevation having an increasing height above the convection chamber bottom in a direction from the rear wall of the convection chamber to the open front. The increasing height enables heated air in the air passage between the convection chamber and fireplace side walls respectively to be deflected forwardly into the room to be heated as will be described in detail below. Disposed along the top edge of each of the convection chamber side walls is a side wall sealing means 20 extending toward the adjacent fireplace side wall. The side wall sealing means engages the fireplace side walls and urges the convection chamber side walls apart from the fireplace side walls such that an air passage is defined therebetween. In addition, each side wall sealing means prevents heated air from reaching the fireplace chimney.

With reference to FIG. 2 and FIG. 4, in one embodiment of the present invention, the side wall sealing means and the rear wall sealing means are identical. In this instance, either sealing means comprises an upper plate 40 slidably movable outwardly on a flange 42 disposed on the top edge of either the convection chamber rear wall or the side wall. The flange extends outwardly toward the fireplace rear wall or side wall respectively. A lower plate 44 is slidably movable outwardly along the bottom surface of the flange 42, and engages the fireplace rear wall or side wall. The lower plate 44 is separated from the upper plate 40 by a downwardly extending section 45 such that a channel, shown generally at 46, is formed between the upper and lower plates. A nonflammable material, such as fiberglass or the like, is disposed within the channel between the upper and lower plates and ensures the sealing means prevents air to be heated from passing around the sealing means into the fireplace chimney. The upper plate 40, the flange 42, and the lower plate 44 are secured from relative motion by a plurality of threaded bolts 50 each securable to a nut 52. The bolts extend downwardly from the top edge of either the convection chamber side walls or rear wall. The upper plate 40, and the lower late 44 have a plurality of slots 54 surrounding each bolt and extending outwardly from each bolt toward the fireplace rear and side walls. The slots facilitate movement of the upper and lower plates outwardly toward the fireplace rear and side walls.

Figure 6:
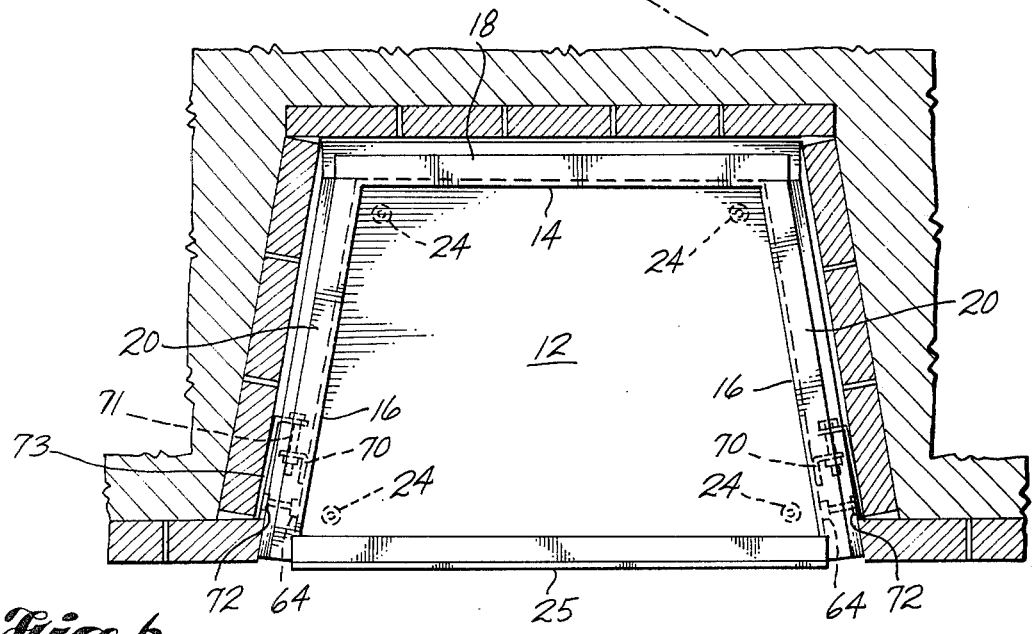
FIG. 6 is a top view of the embodiment of the convection chamber shown in FIG. 5 inserted into an existing fireplace.

With reference to FIGS. 5–7, in an alternate embodiment, either sealing means 18, 20 comprises a flange 19 extending outwardly toward the fireplace. The flange is integral with either the convection chamber side or rear wall, but is is to be understood that flange 19 may be constructed separately from the side or rear wall and secured thereto such as by welding or the like. A downwardly extending section 21 having a lip 23 thereon is secured to the flange 19 such that a channel, shown generally at 47 is formed between the fireplace and the section 21. As has been described, a nonflammable material, such as fiberglass or the like is disposed within the channel to ensure the sealing means prevents air from passing around the sealing means into the fireplace chimney.

Referring to FIGS. 1–3, an expanding means 22 extends across the open front of the convection chamber between adjacent side walls at their top edge. The expanding means is old per se such as a turnbuckle or the like. When the expanding means is rotated, it urges the convection chamber side walls outwardly toward the fireplace side walls, and the sealing means into engagement therewith. In the alternate embodiment illustrated in FIGS. 5–7, the expanding means is replaced by a bar 25 secured to the convection chamber sidewalls at their upper forward edges. The bar extends slightly above the highest point at each side wall to provide a tight closure between the convection chamber and the fireplace as will be described.

Also in the alternative embodiment of the present invention illustrated in FIGS. 5–7, bar 25 forms the upper member of a front face frame 26 which further includes a pair of vertical side bars 27 extending downwardly from bar 25 along the front edge portion of each convection chamber side wall 16 to intersect with a lower bar 28 horizontally interconnecting the lower end portions of side bars 27. Lower bar 28 extends upwardly from chamber bottom 12, and side bars 27 extend inwardly from chamber side walls 16, FIG. 7, to thereby avoid hindering the free convection flow of air within the chambers defined by chamber bottom 12 and the bottom of the fireplace and chamber side walls 16 and the corresponding side walls of the fireplace, respectively. If desired, doors (not shown) may be mounted on side bars 27 to close the opening defined by frame 26. Air vents 29 are provided in lower bar 28 to allow combustion air to enter the convection chamber when the doors are disposed in closed position.

The insertion of the convection chamber into a fireplace will next be described. The convection chamber 10 is first inserted into the fireplace such that the convection chamber bottom 12, side walls 16, and rear wall 14, are spaced apart from the fireplace bottom, side walls and rear wall respectively. The height of the convection chamber bottom above the fireplace bottom may be varied by movably adjusting the plurality of adjustable legs 24 carried on the underside of convection chamber bottom. In a typical operation, the distance the convection chamber bottom, rear wall, and side walls are spaced apart from the existing fireplace bottom, side walls, and rear wall respectively is from between one to four inches. Upon initial insertion of the convection chamber into the fireplace, the front edges of the bottom 12 and side walls 16 are aligned with the existing fireplace facing. After this has been accomplished, the side wall sealing means are engaged to the fireplace side walls by slidably moving the upper plate, the lower plate, and securing the same against movement by the plurality of nuts 52 and bolts 50. When this is done, the expanding means 22 is thereafter adjusted such that the convection chamber side walls are urged outwardly forcing the side wall sealing means into further engagement with the fireplace side walls, and securely containing the convection chamber within the fireplace. Thereafter, the rear wall sealing means is engaged to the fireplace rear wall. This can be done by slidably moving the rear wall sealing means upper plate and lower plate outwardly into engagement with the fireplace rear wall. The plurality of bolts and nuts are thereafter tightened to ensure the sealing means remains securely against the fireplace rear wall.

With respect to the embodiment of the convection chamber shown in FIGS. 5—9, the insertion of the chamber into the fireplace varies somewhat from that described above. The convection chamber is first placed into the fireplace such that the convection chamber bottom, side walls and rear wall are spaced apart from the fireplace bottom, side walls and rear walls respectively. With reference to FIG. 5, each convection chamber side wall carries an angle plate 70 rigidly secured to the side wall such as by welding or the like. Each angle plate has an opening therein enabling a threaded bolt 71 to pass therethrough. An angle-shaped wedge plate 73 comprising an elongate L-shaped metal bar having an opening therethrough is placed between each convection chamber side wall and each fireplace side wall. One end of the wedge plate typically engages the fireplace side wall at the joint formed by the fireplace facing and the fireplace side wall. The other end of the wedge plate initially frictionally engages the convection chamber side wall. When a threaded bolt is placed through the opening in the angle plate and an opening in the wedge plate, rotation of the bolt draws the convection chamber further into the fireplace opening. As the convection chamber is drawn into the fireplace, the rear wall sealing means engages the fireplace rear wall forming a joint therebetween preventing air from passing therearound. Also, as the convection chamber is drawn into the fireplace, a gasket material, having previously been placed across the top of the convection chamber behind bar 25 is compressed between the bar and the fireplace facing thereby sealing the top front edge of the convection chamber opening. The plurality of adjustable legs 24 disposed under the front of the convection chamber are adjusted to give the chamber a front to back tilt further sealing the top front edge. A plurality of expanding screws 72 secured to each convection chamber side wall are extended outwardly to engage the fireplace side walls to rigidly secure the convection chamber in the fireplace.

With reference to FIGS. 1, 2 and 5, the operation of the present invention will next be described. The convection chamber being spaced apart from the fireplace defines an air passage under the convection chamber bottom, shown generally at 60, an air passage behind the rear wall of the convection chamber, shown generally at 62, and an air passage along the sides of the convection chamber, shown generally at 64 and 66. When a combustible material, such as a plurality of logs or the like, is placed on the convection chamber bottom and ignited, cold air from the room to be heated is drawn under the convection chamber bottom through air passage 60 and around the lower portion of convection chamber side walls through the air passages 64 and 66. As this air is drawn beneath the combustible materials, it is heated and rises up towards the fireplace chimney through the air passage 62. This air is prevented from escaping through the fireplace chimney by rear wall sealing means. The trapped air is subsequently urged around the convection chamber through the air passage 64, 66. The side wall sealing means 20 prevents this heated air from escaping through the fireplace chimney. The heated air is subsequently urged forwardly toward the open end of the convection chamber, in part by the shape of the side walls. The heated air is discharged forwardly out into the room to be heated at the upper portions of the air passages 64, 66. To further improve the efficiency of the present invention, a plurality of glass doors or the like (not shown) may be disposed across the open front of the convection chamber to prevent the subsequent escape of the heated air through the fireplace chimney.

I claim:

1. An apparatus for improving the thermal efficiency of an existing fireplace comprising:

(a) a convection chamber having an open front and top, a bottom, a rear wall, and a plurality of side walls, said convection chamber being insertable into a fireplace and spaced apart from the bottom, rear wall, and side walls of the fireplace to cooperatively form air chambers therebetween for drawing room air to be heated under and behind said convection chamber, heating the room air as it passes through said bottom, rear and side air chamber, and discharging heated air into a room from the air side chambers defined by the fireplace side walls and said convection chamber side walls;

(b) rear wall sealing means disposed along the top edge of and extending rearwardly from said convection chamber rear wall, said rear wall sealing means engaging said fireplace rear wall to prevent air conveyed from said room to be heated from passing therearound;

(c) side wall sealing means extending outwardly from the upper edge portion of each of said convection chamber side walls, said side wall sealing means engaging said fireplace side walls to prevent heated air from passing therearound.

2. The apparatus of claim 1 wherein each of said convection chamber side walls is characterized by a side elevation having an increasing height above said convection chamber bottom in a direction from the rear wall of said convection chamber to the open front thereby enabling heated air to be deflected forwardly into the room to be heated along the top edge of each of said side walls in the air chamber defined between said convection chamber side walls and said fireplace side walls.

3. The apparatus of claim 1 wherein the convection chamber bottom, rear wall, and plurality of side walls are each constructed from metal.

4. The apparatus of claim 1, wherein the rear wall sealing means comprises:

(a) a flange integral with the convection chamber rear wall extending rearwardly therefrom toward said fireplace rear wall;

(b) a downwardly extending section secured to said flange, said section having a lip thereon spaced below said rear wall flange, said lip defining, in part, a channel between said section and said fireplace rear wall; and, (c) a nonflammable material disposed within said channel between said section and said fireplace rear wall.

5. The apparatus of claim 1 wherein the side wall sealing means comprises:

(a) a flange integral with a convection chamber side wall extending outwardly therefrom toward a corresponding fireplace side wall;

(b) a downwardly extending section secured to said flange, said section having a lip thereon spaced below said side wall flange, said lip defining, in part, a channel between said section and the corresponding fireplace side walls; and, (c) a nonflammable material disposed within said channel between said section and the corresponding fireplace side wall.

6. The apparatus of claim 1 wherein said convection chamber side walls further carry means expandable outwardly toward said fireplace side walls to engage same and secure said convection chamber within said fireplace.

7. The apparatus of claim 1 wherein each convection chamber side wall carries means enabling said convection chamber to be urged into said fireplace.

8. The apparatus of claim 1 wherein the distance said convection chamber bottom, rear wall and side walls are spaced apart from the corresponding bottom, rear wall and side walls of said fireplace is from between one to four inches.

9. An apparatus for improving the thermal efficiency of an existing fireplace comprising:

(a) a convection chamber having an open front and top, a bottom, a rear wall, and a plurality of side walls, said convection chamber being insertable into a fireplace and spaced apart from the bottom, rear wall, and side walls of the fireplace to define air passages therebetween for drawing room air to be heated under and behind said convection chamber, and discharging heated air into a room from the air passages defined by the fireplace side walls and said convection chamber side walls;

(b) rear wall sealing means disposed along the top edge of said convection chamber rear wall extending outwardly therefrom, said rear wall sealing means engaging said fireplace rear wall preventing air conveyed from said room to be heated from passing therearound;

(c) side wall sealing means disposed along the top edge of each of said plurality of convection chamber side walls extending outwardly therefrom, said side wall sealing means engaging said fireplace side walls preventing heated air from passing therearound; and wherein the convection chamber rear wall sealing means comprises:

a flange extending outwardly from said convection chamber rear wall toward said fireplace rear wall along the top edge of said convection chamber rear wall;

an upper plate slidably movable along the top surface of said flange into engagement with said fireplace rear wall;

a lower plate slidably movable along the bottom surface of said flange into engagement with said fireplace rear wall, said lower plate having a downwardly extending section thereon forming a channel between said upper plate and said lower plate;

a nonflammable material disposed within said channel; and, means for securing said upper plate and said lower plate to said flange at intervals along the length of said combustion chamber rear wall.

10. The apparatus of claim 5 wherein said nonflammable material is fibrous.

11. An apparatus for improving the thermal efficiency of an existing fireplace comprising:

(a) a convection chamber having an open front and top, a bottom, a rear wall, and a plurality of side walls, said convection chamber being insertable into a fireplace and spaced apart from the bottom, rear wall, and side walls of the fireplace to define air passages therebetween for drawing room air to be heated under and behind said convection chamber, and discharging heated air into a room from the air passages defined by the fireplace side walls and said convection chamber side walls;

(b) a rear wall sealing means disposed along the top edge of said convection chamber rear wall extending outwardly therefrom, said rear wall sealing means engaging said fireplace rear wall preventing air conveyed from said room to be heated from passing therearound;

(c) side wall sealing means disposed along the top edge of each of said plurality of convection chamber side walls extending outwardly therefrom, said side wall sealing means engaging said fireplace side walls preventing heated air from passing therearound; and (d) wherein each convection chamber side wall sealing means comprises:

a flange extending outwardly from said convection chamber side wall toward said fireplace side wall along the top edge of said convection chamber side wall;

an upper plate slidably movable along the top surface of said flange into engagement with said fireplace side wall;

a lower plate slidably movable along the bottom surface of said flange into engagement with said fireplace side wall, said lower plate having a downwardly extending section forming a channel between said upper plate and said lower plate;

a nonflammable material disposed within said channel; and, means for securing said upper plate and said lower plate to said flange at intervals along the length of said convection chamber side wall.

12. The apparatus of claim 11 wherein said nonflammable material is fibrous.

13. A convection chamber disposed within an existing fireplace to improve the thermal efficiency thereof, said convection chamber having an open front and top, and comprising:

(a) a bottom member spaced upwardly from the fireplace bottom to cooperatively form an air chamber for drawing by natural convection room air to be heated beneath said convection chamber;

(b) a rear wall joined to said bottom member and spaced forwardly from the fireplace rear wall to cooperatively form an air chamber therebetween for drawing by natural convection room air to be heated behind said convection chamber, said convection chamber rear wall including a sealing means disposed along the top edge thereof extending rearwardly therefrom and sealing against said fireplace rear wall preventing air from passing upwardly therearound;

(c) a pair of convection chamber side walls spaced inwardly from corresponding fireplace side walls and joined to opposite side edges of said convection chamber bottom and said rear wall, said side walls each having sealing means extending outwardly from the top edge thereof for sealing against corresponding fireplace side walls to prevent air from passing upwardly therearound, said side walls further being characterized by a side elevation having an increasing height above said combustion chamber bottom in a direction from said combustion chamber rear wall to said combustion chamber open front to thereby facilitate the heated air in the air chambers defined between said combustion chamber side walls and corresponding fireplace side walls to be deflected forwardly into the room to be heated along the top edge of each of said combustion chamber side walls.

14. The apparatus of claim 13 wherein the convection chamber bottom, rear wall, and plurality of side walls are each constructed from metal.

15. The apparatus of claim 13 wherein the convection chamber rear wall sealing means comprises:

(a) a flange extending outwardly from said convection chamber rear wall toward said fireplace rear wall along the top edge of said convection chamber rear wall;

(b) an upper plate slidably movable along the top surface of said flange into engagement with said fireplace rear wall;

(c) a lower plate slidably movable along the bottom surface of said flange into engagement with said fireplace rear wall, said lower plate having a downwardly extending section thereon forming a channel between said upper plate and said lower plate;

(d) a nonflammable material disposed within said channel; and, (e) means for securing said upper plate and said lower plate to said flange at intervals along the length of said combustion chamber rear wall.

16. The apparatus of claim 15 wherein said nonflammable material is fibrous.

17. The apparatus of claim 13 wherein each convection chamber side wall sealing means comprises:

(a) a flange extending outwardly from said convection chamber side wall toward said fireplace side wall along the top edge of said convection chamber side wall;

(b) an upper plate slidably movable along the top surface of said flange into engagement with said fireplace side wall;

(c) a lower plate slidably movable along the bottom surface of said flange into engagement with said fireplace side wall, said lower plate having a downwardly extending section forming a channel between said upper plate and said lower plate;

(d) a nonflammable material disposed within said channel; and, (e) means for securing said upper plate and said lower plate to said flange at intervals along the length of said convection chamber side wall.

18. The apparatus of claim 17 wherein said nonflammable material is fibrous.

19. The apparatus of claim 13 wherein the rear wall sealing means comprises:

(a) a flange integral with the rear wall extending rearwardly therefrom toward said fireplace rear wall;

(b) a downwardly extending section secured to said flange, said section having a lip thereon spaced below said rear wall flange, said lip defining, in part, a channel between said section and said fireplace rear wall; and, (c) a nonflammable material disposed within said channel between said section and said fireplace rear wall.

20. The apparatus of claim 13 wherein the side wall sealing means comprises:

(a) a flange integral with a convection chamber side wall extending outwardly therefrom toward a corresponding fireplace side wall;

(b) a downwardly extending section secured to said flange, said section having a lip thereon spaced below said side wall flange, said lip defining, in part, a channel between said section and the corresponding fireplace side walls; and, (c) a nonflammable material disposed within said channel between said section and the corresponding fireplace side walls.

21. The apparatus of claim 13 wherein said convection chamber side walls further carry means expandable outwardly toward said fireplace side walls to engage same and secure said convection chamber within said fireplace.

22. The apparatus of claim 13 wherein each convection chamber side wall carries means for pushing said convection chamber rearwardly into said fireplace and maintaining the convection chamber in such position.

23. The apparatus of claim 13 wherein the distance said convection chamber is spaced apart from said fireplace is from between one to four inches.

* * * * *